US006468193B1

(12) United States Patent
Shimoda

(10) Patent No.: US 6,468,193 B1
(45) Date of Patent: Oct. 22, 2002

(54) LIQUID TONER TYPE IMAGE FORMATION APPARATUS SQUEEZE ROLLER

(75) Inventor: Takenobu Shimoda, Niigata (JP)

(73) Assignee: Fuji Xerox Co., Ltd., Tokyo (JP)

( * ) Notice: Subject to any disclaimer, the term of this patent is extended or adjusted under 35 U.S.C. 154(b) by 87 days.

(21) Appl. No.: 09/634,696

(22) Filed: Aug. 8, 2000

(30) Foreign Application Priority Data

Aug. 13, 1999 (JP) ..... 11-229058

(51) Int. Cl.[7] ..... B25F 5/02
(52) U.S. Cl. ..... 492/45; 29/895.21
(58) Field of Search ..... 492/6, 7, 59, 39, 492/45, 47, 56, 21, 60, 48, 49; 29/895.21, 895.212, 895.22; 100/155 R, 162 B, 60, 48, 49

(56) References Cited

U.S. PATENT DOCUMENTS 1,114,426 A * 10/1914 Aitken ..... 492/45
2,005,885 A * 6/1935 Brindley ..... 492/7
3,685,443 A * 8/1972 Kusters ..... 492/56
3,737,963 A * 6/1973 Postulka et al. ..... 492/9
3,941,435 A * 3/1976 Tuomaala ..... 492/6
4,305,191 A * 12/1981 Enomoto ..... 492/7
4,372,205 A * 2/1983 Pflaum ..... 492/7
4,612,692 A * 9/1986 Molinatto ..... 492/7
4,815,370 A * 3/1989 Collins ..... 29/895.21
4,823,450 A * 4/1989 Ramisch et al. ..... 492/7
4,860,416 A * 8/1989 Masui et al. ..... 492/7
5,001,820 A * 3/1991 Yoshida et al. ..... 492/7
5,142,784 A * 9/1992 Lee et al. ..... 29/895.21
5,290,223 A * 3/1994 Lehmann ..... 492/7

* cited by examiner

*Primary Examiner*—I. Cuda-Rosenbaum
*Assistant Examiner*—Marc Jimenez
(74) *Attorney, Agent, or Firm*—McGinn & Gibb, PLLC

(57) ABSTRACT

The present invention provides a liquid toner type image formation apparatus squeeze roller capable of generating a uniform pressure in the longitudinal direction of the roller portion and rotating the roller portion according to the rotation of the shaft portion even after a long period of use. The squeeze roller 1 comprises: a roller portion 2 having a metal pipe 4 and an elastic body 5 formed with a uniform thickness on the metal pipe 4; a press fit member 7 inserted in the center portion of the metal pipe 4 in the longitudinal direction; a shaft portion 3 having a diameter reduced at both ends in the longitudinal direction and a center portion having a length almost identical to that of the press fit member 7 and pressed against the inner surface of the press fit member 7; metal pins 6 fixed at an identical distance from the center of the roller portion and the press fit member in the longitudinal direction.

11 Claims, 3 Drawing Sheets

LIQUID TONER TYPE IMAGE FORMATION APPARATUS SQUEEZE ROLLER

BACKCGROUND OF THE INVENTION

1. Field of the Invention

The present invention relates to a squeeze roller of a liquid toner type image formation apparatus.

2. Description of the Related Art

Conventionally, in a roller made from a metal pipe rotating while applying a load, pressure is made uniform with respect to the roller longitudinal direction utilizing the elasticity of the metal pipe as follows. The metal pipe and a shaft portion are fixed to each other with a metal pin or the metal pipe and the shaft portion are connected to each other by press fit. However, there is a problem that in the aforementioned roller, the pressure of the connected portion becomes high and it is impossible to obtain a uniform pressure in the roller longitudinal direction.

Moreover, as means for eliminating a high pressure portion, there is means to apply an adhesive in the clearance between the metal pipe and the shaft portion. However, in the aforementioned roller, after rotated with a load for a long period of time, the fixing force at a portion attaching the shaft portion to the metal pipe becomes weaker and a sliding occurs between the shaft portion and the metal piping, disabling to obtain a roller rotation matched with the rotation of the shaft portion.

The first problem of this conventional roller is that the pressure cannot be made uniform in the roller longitudinal direction. The reason is that the pressure of the connected portion becomes high.

The second problem is that it is impossible to obtain a roller rotation matched with the rotation of the shaft portion. The reason is that after a long period of use in rotation with a load, the fixing force at the portion where the shaft portion is attached to the metal pipe becomes weaker and sliding occurs between the shaft portion and the metal pipe.

SUMMARY OF THE INVENTION

It is therefore an object of the present invention to provide a liquid toner type image formation apparatus squeeze roller capable of generating a uniform pressure in the longitudinal direction of the roller portion and the roller portion can be rotated following the rotation of the shaft portion for a long period of time.

The liquid toner type image formation apparatus squeeze roller according to the present invention comprises: a roller portion having a metal pipe and an elastic body formed with a uniform thickness on the metal pipe; a press fit member inserted in the center portion of the metal pipe in the longitudinal direction; a shaft portion having a diameter reduced at both ends in the longitudinal direction and a center portion having a length almost identical to that of the press fit member and pressed against the inner surface of the press fit member; metal pins fixed at an identical distance from the center of the roller portion and the press fit member in the. longitudinal direction.

Moreover, in the liquid toner type image formation apparatus according to the present invention, the metal pins have a configuration connected only to the metal pipe and not connected to the shaft portion.

Furthermore, in the liquid toner type image formation apparatus squeeze roller according to the present invention, the press fit member is made from a resin or rubber having an elastic modulus smaller than that of the metal pipe.

Furthermore, in the liquid toner type image formation apparatus squeeze roller according to the present invention, the reduced diameter of the both ends of the shaft portion is such that the metal pipe deflected by a load during printing will not touch the shaft portion.

Furthermore, in the liquid toner type image formation apparatus squeeze roller according to the present invention, the metal pipe has such a thickness that an amount of deflection generated by a load during printing is identical to the amount of deflection of the backup roller.

Furthermore, the liquid toner type image formation apparatus squeeze roller according to the present invention is rotated according to the progress direction of a photosensitive belt having a photosensitive body while applying a load of 20 kgf or above to the backup roller via the photosensitive belt, so that a solvent of a liquid toner is removed from an image developed on the photosensitive belt.

Furthermore, the liquid toner type image formation apparatus squeeze roller according to the present invention is rotated, upon completion of a printing, in the opposite direction to the progress direction of the photosensitive belt while applying load of about 3 kgf to the backup roller via the photosensitive belt, so that the liquid toner remaining on the photosensitive belt is removed.

DESCRIPTION OF THE PREFERRED EMBODIMENTS

Description will now be directed to a preferred embodiment of the present invention with reference to the attached drawings.

Figure 1:
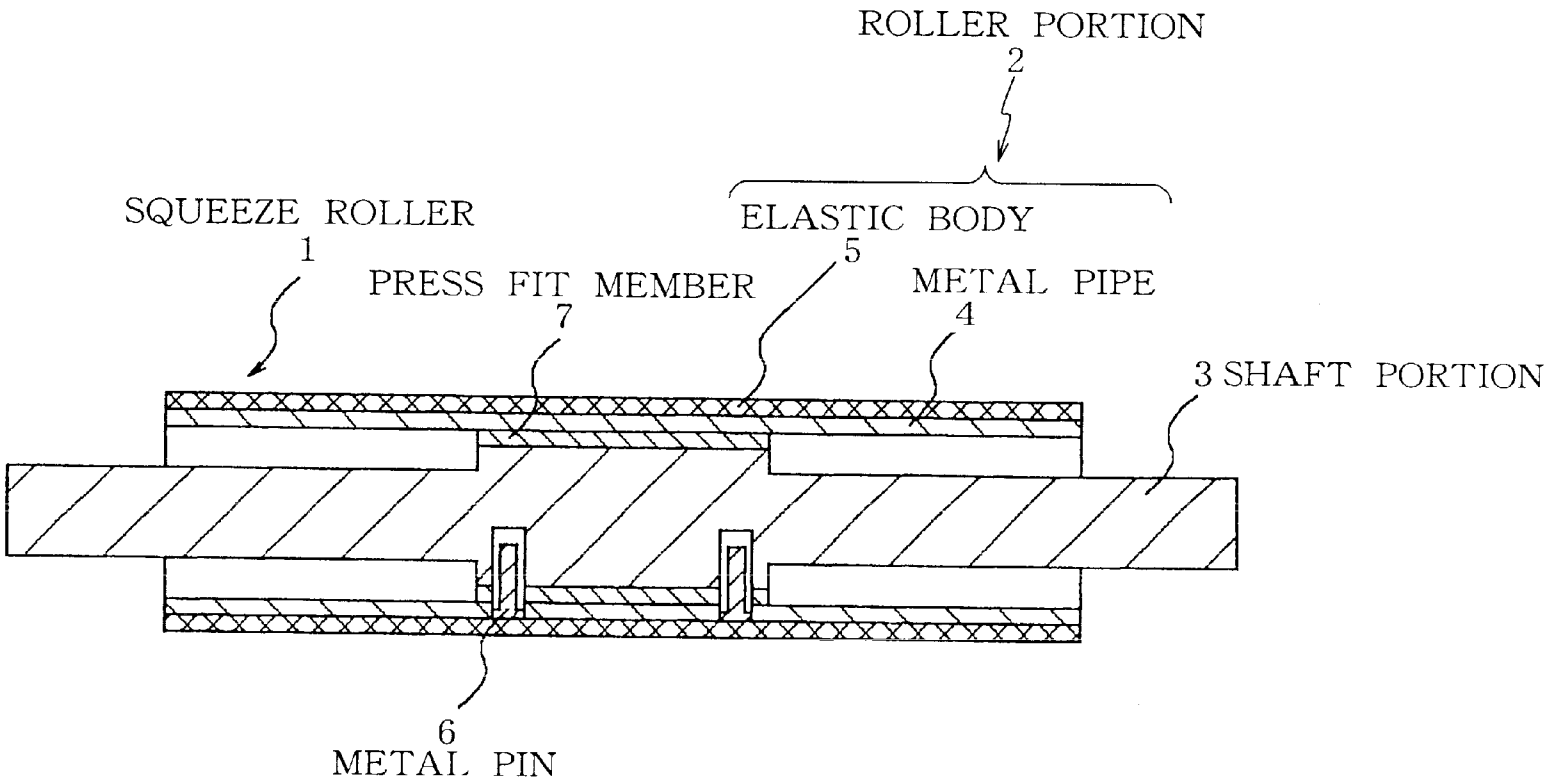
FIG. 1 is a cross sectional view showing an outline of the configuration of a first embodiment of the present invention.

FIG. 1 is a cross sectional view showing an outline of the configuration of a first embodiment of the present invention. Referring to FIG. 1, the liquid toner type image formation apparatus squeeze roller 1 according to the present embodiment includes: a roller portion 2 having an urethane elastic body 5 formed with a uniform thickness on a metal pipe 4 made from stainless steel or aluminum; a press fit member 7 made from a resin or rubber having an elastic modulus slightly smaller than that of the metal pipe 4 and arranged inside the metal pipe 4; and a shaft portion 3 having a diameter enlarged at its center portion in the longitudinal direction so that the press fit member 7 is sandwiched between the enlarged portion of the shaft portion 3 and the metal pipe 4.

The shaft portion 3 and the press fit member 7 are inserted into the metal pipe 4 so that the center of the shaft portion and the press fit member 7 in the longitudinal direction is matched with the center of the roller portion 2 in the longitudinal direction. The shaft portion 3 and the press fit member 7 are fixed by metal pins 6 arranged at an identical distance from the center of the metal pipe 4 in the longitudinal direction. Note that the metal pins 6 are connected only to the metal pipe 4 and not connected to the press fit member 7 or the shaft portion 3. The shaft portion 3 has such a diameter that the shaft portion 3 is not brought into contact with the inner surface of the metal pipe 4 when the metal pipe 4 is deflected by a load.

The roller portion 2 is formed from the elastic body 5 such as urethane having a uniform thickness arranged on the metal pipe 4 made from a stainless steel, aluminum, or the like. The elastic body 5 is formed after the metal pins 6 are connected to the metal pipe 4. The metal pipe 4 has such a thickness that an amount of deflection generated by a load during a printing is identical to the deflection amount of a backup roller 8.

Figure 2:
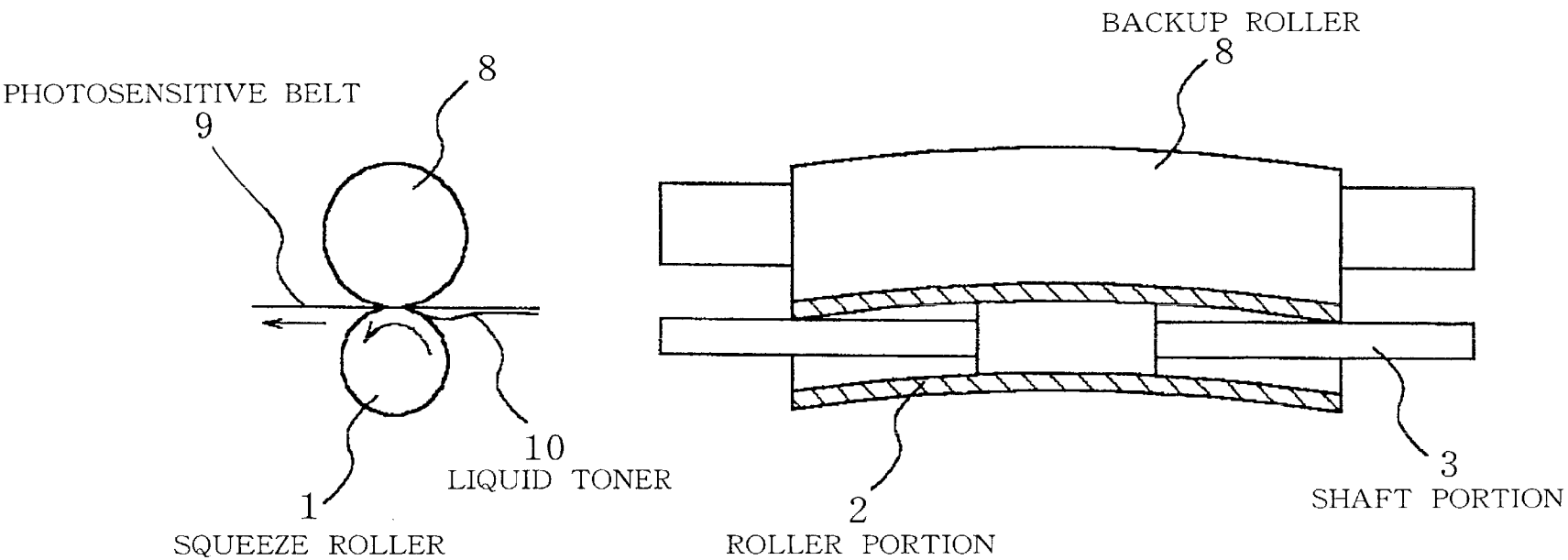
FIG. 2 explains an operation of the liquid toner type image formation apparatus. squeeze roller according to the embodiment during printing.

FIG. 2 explains an operation of the liquid toner type image formation apparatus squeeze roller according to the embodiment during printing.

Referring to FIG. 2 together with FIG. 1, during a printing, a load is applied to the shaft portion 3 of the squeeze roller 1 so that a load of 20 kgf or more is applied between the backup roller 8 and the roller portion 2 of the squeeze roller 1. The squeeze roller 1 is passively rotating according to the movement of a main scan direction of a photosensitive belt 9. Here, the both ends of the roller portion 2 of the squeeze roller 1 are not fixed to the shaft portion 3 and deflected together with the deflection of the backup roller 8. Since the press fit member 7 has an elastic modulus slightly smaller than that of the metal pipe 4 and the metal pipe 4 and the shaft portion 3 are not connected by the metal pins 6, there will not arise a portion of an increased pressure and it is possible to obtain a uniform pressure in the longitudinal direction of the roller portion 2. Thus, a liquid toner 10 developed on the photosensitive belt 9 is pressed by passing of the squeeze roller 1 so that only a solvent contained with a predetermined ratio in the liquid toner 10 is removed and the toner particles developed in the liquid toner 10 are fixed onto the photosensitive belt 9.

Figure 3:
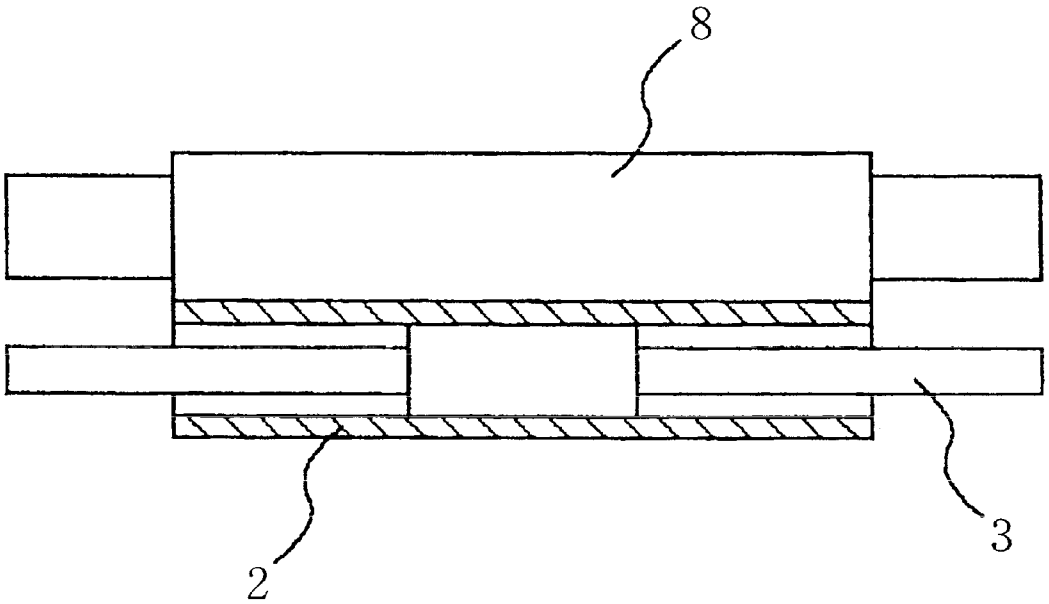
FIG. 3 explains an operation of the liquid toner type image formation apparatus squeeze roller according to the embodiment upon completion of printing.
Figure 3:
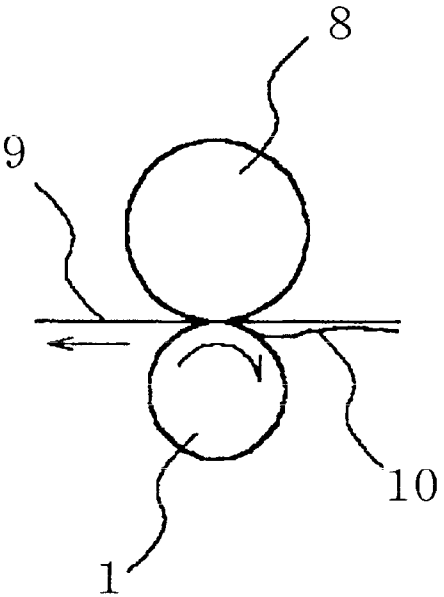

FIG. 3 explains an operation of the liquid toner type image formation apparatus squeeze roller according to the embodiment upon completion of printing.

Referring to FIG. 3 together with FIG. 1, upon completion of printing, a load is applied to the shaft portion 3 of the squeeze roller so that a load of 3 kgf is applied between the backup roller 8 and the roller portion 2 of the squeeze roller 1 and the squeeze roller 1 is rotating in the opposite direction with respect to the main scan direction of the photosensitive belt 9. Here, the deflection amount of the both ends of the roller portion 2 is reduced according to the reduction of the deflection amount of the backup roller 8 and a uniform pressure in the longitudinal direction of the roller portion 2 is applied to the roller portion 2. Thus, when the squeeze roller 1 passes through, the liquid toner 10 remaining on the photosensitive belt 9 is removed.

As has been described above, in the image formation apparatus using a liquid toner containing toner dispersed in a solvent, the squeeze roller removes the solvent of the liquid toner with a desired pressure from an image developed on the photosensitive belt. When the squeeze roller is rotated according to the progress direction of the photosensitive belt while applying a load of 20 kgf or above to the backup roller via the photosensitive belt during printing and when the squeeze roller is rotated in the opposite direction to the progress direction of the photosensitive belt while applying a load of about 3 kgf to the backup roller via the photosensitive belt so as to remove the liquid toner remaining on the photosensitive belt upon completion of printing, it is possible to generate a uniform pressure in the longitudinal direction of the roller portion and to rotate the roller portion according to the rotation of the shaft portion even after a long period of time in use.

Description will now be directed to effects of the present invention.

The first effect is that during a printing when a load of 20 kgf or above is applied to the backup roller via the photosensitive belt, according to the deflection of the backup roller, the squeeze roller is deflected from the center toward the both ends of the roller portion and it is possible to generate a uniform pressure in the longitudinal direction of the roller portion while rotating roller portion according to the progress direction of the photosensitive belt.

The reason is that the squeeze roller includes: the roller portion an elastic body made from urethane or the like on the surface of the metal pipe made from stainless steel or aluminum; the press fit member made from a resin or rubber having an elastic modulus slightly smaller than that of the metal pipe and arranged at the center portion of the roller portion in the longitudinal direction; the shaft portion forming the press fit portion in side the press fit member; and metal pins arranged at an identical distance from the center of the roller portion in the longitudinal direction and connected to the metal pipe but not connected to the shaft portion.

The second effect is that upon completion of printing, when the squeeze roller is rotated in the opposite direction of the main scan direction of the photosensitive belt while applying a load of about 3 kgf to the backup roller via the photosensitive belt so as to remove the liquid toner remaining on the photosensitive belt, as the deflection of the backup roller is reduced, the deflection of the roller portion is reduced, and the roller portion is rotated according to the rotation of the shaft, it is possible to rotate the squeeze roller in the opposite direction to the progress direction of the photosensitive belt while generating a uniform pressure.

The invention may be embodied in other specific forms without departing from the spirit or essential characteristic thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 11-229058 (Filed on Aug. 13$^{th}$, 1999) including specification, claims, drawings and summary are incorporated herein by reference in its entirety.

What is claimed is:

1. A liquid toner type image formation apparatus squeeze roller comprising:

a roller portion having a metal pipe and an elastic body formed with a uniform thickness on the metal pipe;

a press fit member inserted in the center portion of the metal pipe in the longitudinal direction and having an outer surface directly contacting said metal pipe;

a shaft portion having a diameter reduced at both ends in the longitudinal direction and an enlarged center portion having a length substantially identical to that of the press fit member and pressed against an inner surface of the press fit member; and metal pins fixed at a substantially identical distance from the center of the roller portion and the press fit member in the longitudinal direction while oriented perpendicular to the longitudinal direction within the enlarged center portion.

2. A liquid toner type image formation apparatus squeeze roller as claimed in claim 1, wherein the elastic body is made from urethane.

3. A liquid toner type image formation apparatus squeeze roller as claimed in claim 1, wherein the metal pins have a configuration connected only to the metal pipe and not connected to the shaft portion.

4. A liquid toner type image formation apparatus squeeze roller as claimed in claim 1, wherein the press fit member is made from a resin or rubber having an elastic modulus smaller than that of the metal pipe.

5. A liquid toner type image formation apparatus squeeze roller as claimed in claim 1, wherein the reduced diameter of the both ends of the shaft portion is such that the metal pipe deflected by a load during printing will not touch the shaft portion.

6. A liquid toner type image formation apparatus squeeze roller as claimed in claim 1, wherein the metal pipe is made from a stainless steel or aluminum material.

7. A liquid toner type image formation apparatus squeeze roller as claimed in claim 1, wherein the metal pipe has such a thickness that an amount of deflection generated by a load during printing is identical to the amount of deflection of a backup roller.

8. A liquid toner type image formation apparatus squeeze roller as claimed in claim 1, wherein the squeeze roller is rotated according to the progress direction of a photosensitive belt having a photosensitive body while applying a load of 20 kgf or above to a backup roller via the photosensitive belt, so that a solvent of a liquid toner is removed from an image developed on the photosensitive belt.

9. A liquid toner type image formation apparatus squeeze roller as claimed in claim 1, wherein upon completion of a printing, the squeeze roller is rotated in the opposite direction to the progress direction of a photosensitive belt while applying load of about 3 kgf to a backup roller via the photosensitive belt, so that the liquid toner remaining on the photosensitive belt is removed.

10. The liquid toner type image formation apparatus squeeze roller according to claim 1, wherein the shaft portion is integrally formed.

11. A method of forming a liquid toner image formation apparatus squeeze roller, comprising:

forming a roller portion having a metal pipe and an elastic body with a uniform thickness on the metal pipe;

inserting a press fit member in the center portion of the metal pipe in the longitudinal direction while having an outer surface of the press fit member directly contact said metal pipe;

forming a shaft portion having a diameter reduced at both ends in the longitudinal direction and an enlarged center portion having a length substantially identical to that of the press fit member and pressed against an inner surface of the press fit member; and fixing metal pins at a substantially identical distance from the center of the roller portion and the press fit member in the longitudinal direction while oriented perpendicular to the longitudinal direction within the enlarged center portion, wherein a uniform pressure is generated in the longitudinal direction of the roller portion to enhance rotation of the roller portion according to the rotation of the shaft portion even after a long period of use.

* * * * *